United States Patent [19]

Murray

[11] 4,105,406

[45] Aug. 8, 1978

[54] METHOD OF INHIBITING CORROSION USING A HEXAMETAPHOSPHATE AND A PHOSPHATE BUFFER

[76] Inventor: W. Bruce Murray, 7119 Sea Wind Dr., Long Beach, Calif. 90803

[21] Appl. No.: 755,627

[22] Filed: Dec. 30, 1976

[51] Int. Cl.[2] ..... C09K 15/02; C23F 9/02; C23F 11/18

[52] U.S. Cl. ..... 21/2.7 R; 252/387; 252/389 A

[58] Field of Search ..... 21/2.7 R; 252/387, 389 A

[56] References Cited

U.S. PATENT DOCUMENTS

| | | | |
|---|---|---|---|
| 2,711,391 | 6/1955 | Kahler | 21/2.7 R |
| 2,901,438 | 8/1959 | Rogers | 252/389 A |
| 3,081,146 | 3/1963 | Boies et al. | 21/2.7 R |
| 3,099,521 | 7/1963 | Arensberg | 252/389 A |

*Primary Examiner*—Morris O. Wolk
*Assistant Examiner*—Bradley Garris
*Attorney, Agent, or Firm*—Fulwider, Patton, Rieber, Lee & Utecht

[57] ABSTRACT

Method for prevention of corrosion of iron and mild steel surfaces in contact with water. The invention is primarily directed to treatment of potable water such as municipal waters and the like which have limits on the concentrations of additives such as phosphates and the like that have been previously employed for corrosion inhibition. It has been found that the addition of a limited amount of an orthophosphate buffer such as phosphoric acid or sodium dihydrogen orthophosphate greatly reduces the concentration of a hexametaphosphate corrosion inhibitor necessary for passivation of metal surfaces and the necessary level of the metaphosphate for maintaining the passivating film. This combined use of the orthophosphate buffer and the hexametaphosphate inhibitor so greatly reduces the necessary concentration of the latter that it is possible to treat municipal waters in accordance with the invention while meeting all the applicable standards or limits on the concentration of phosphates and the like in the water. In the typical treatment, passivation of the metal surfaces can be achieved at concentrations of the orthophosphate buffer and metaphosphate inhibitor from ten to about twenty parts per million (ppm). After passivation, the concentration of the hexametaphosphate inhibitor can be reduced to a range from 0.5 to about 5 ppm. The passivation treatment is preferably practiced employing the orthophosphate buffer and hexametaphosphate inhibitor in weight proportions from about 2-1 to about 1-2.

12 Claims, 2 Drawing Figures

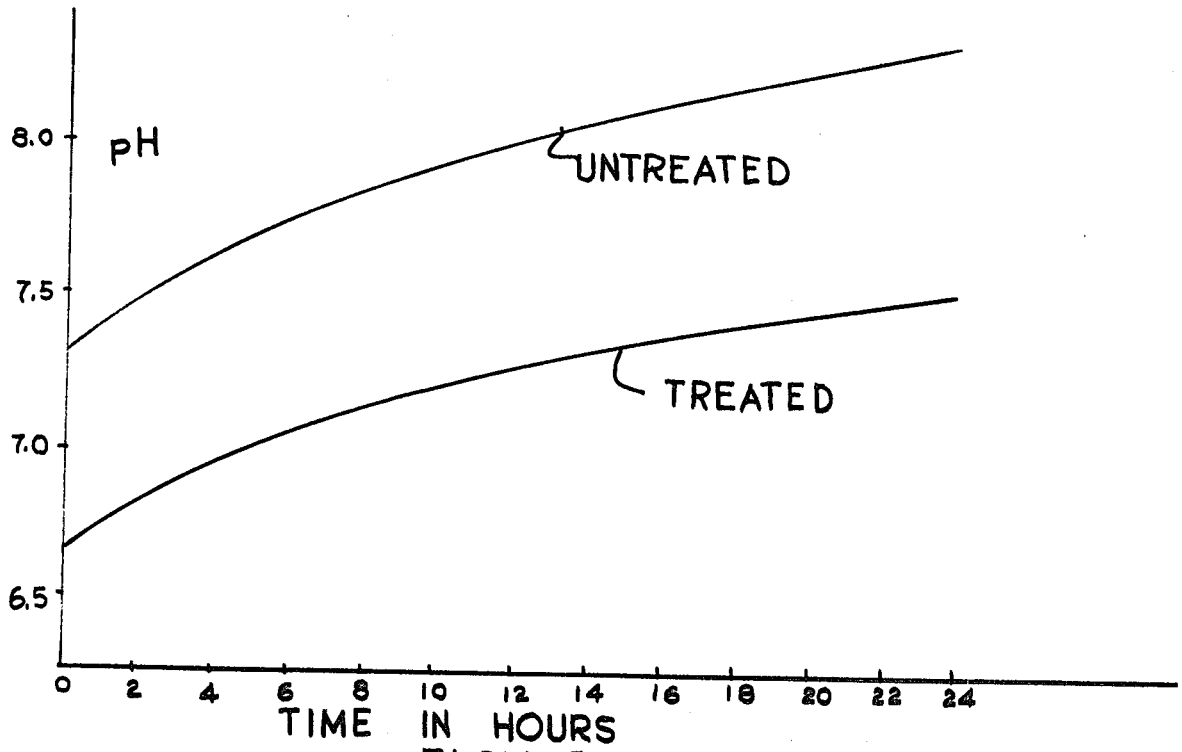
FIGURE 2
FIGURE 1
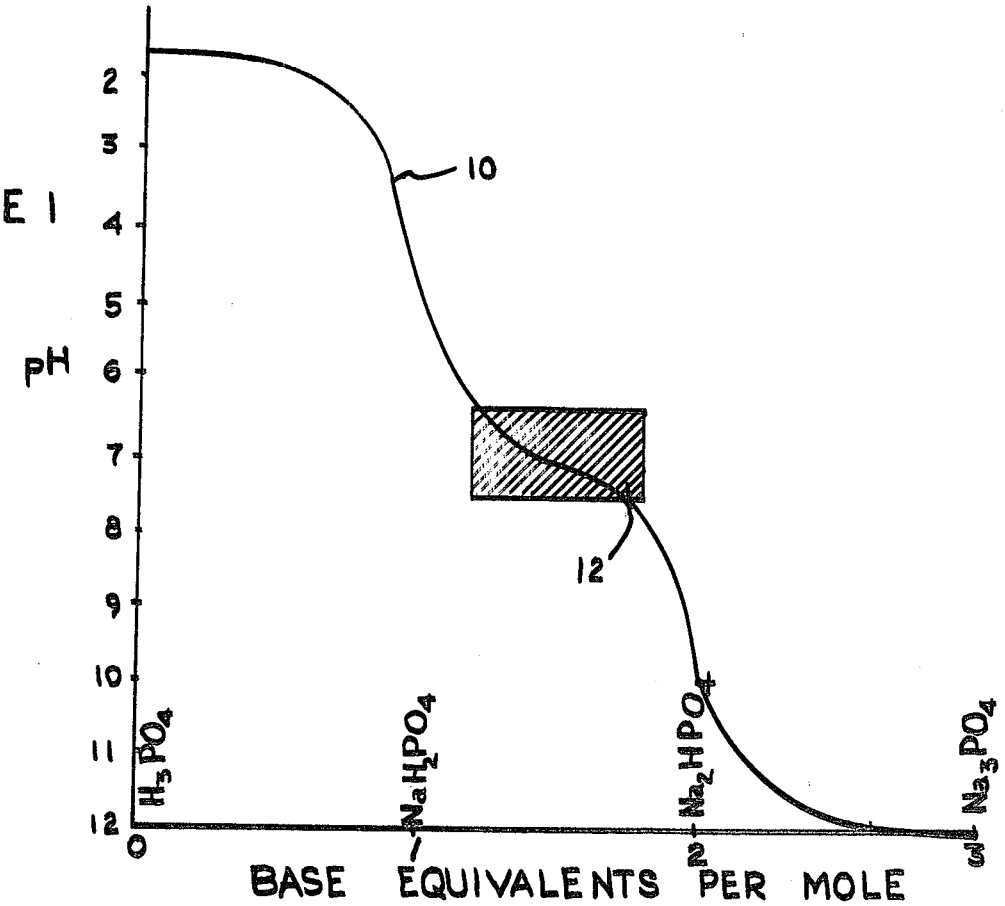

METHOD OF INHIBITING CORROSION USING A HEXAMETAPHOSPHATE AND A PHOSPHATE BUFFER

BACKGROUND OF THE INVENTION

1. Field of the Invention

This invention relates to corrosion inhibition and, in particular, to corrosion inhibition by potable waters such as municipal drinking waters and the like.

2. Brief Description of the Prior Art

Treatment of water with soluble salts such as alkali metal hexametaphosphates has been practiced for many years. The hexametaphosphate salts were initially employed in threshold treatment of waters such as boiler feed water and the like since it was recognized that the hexametaphosphate was a strong complexing agent for iron and manganese, preventing their precipitation and resultant scale formation on the equipment of steam power plants.

An outgrowth of the threshold treatment of water was the discovery that the hexametaphosphate salts could also be employed to inhibit or prevent corrosion of iron and mild steel surfaces. The exact mechanism of this corrosion prevention is not entirely understood although it is generally believed that the hexametaphosphate forms a protective, passivating film on the metal surfaces. It has long been recognized that the hexametaphosphate must be employed at concentrations of at least about 50 or 60 ppm to achieve passivating of fresh metal surfaces, following which the concentration can be reduced to about 20–30 ppm to maintain the film. Attempts to achieve corrosion prevention with lower concentrations of the hexametaphosphate have not been successful in reducing the overall corrosion rate, although some investigators have reported that hexametaphosphate salts have been observed to reduce the pitting nature of the corrosion when employed in low concentration.

It is desirable to minimize the quantities of phosphate additives in water to lessen the risk of promoting growth of algae and aquatic plants. It is also desirable to minimize the amounts of complex phosphates, such as hexametaphosphate in water to avoid undesirable coagulation problems.

DESCRIPTION OF THE DRAWINGS

FIG. 1 illustrates the buffer capacity of the orthophoric acid; and

FIG. 2 illustrates the solution pH values of treated and untreated water.

BRIEF DESCRIPTION OF THE INVENTION

I have now found that the corrosive attack of water on the surfaces of iron or mild steel equipment in contact with the water can be markedly reduced, or effectively eliminated, by the addition, to the water, of an orthophosphate buffer and a metaphosphate corrosion inhibitor. I have further found that this joint use of the orthophosphate and metaphosphate greatly reduces the concentration of the metaphosphate necessary for the corrosion inhibition. Accordingly, the invention provides an effective method for corrosion inhibition of municipal waters and the like.

The method of the invention is practiced by adding to potable water in contact with surfaces of iron or mild steel equipment, an alkali metal hexametaphosphate at concentration no greater than about 20 ppm and orthophosphoric acid and/or an alkali metal dihydrogen orthophosphate, also at a concentration no greater than about 20 ppm. The hexametaphosphate, if used alone, at the aforesaid maximum concentration is ineffective in passivation of iron or mild steel surfaces. When used, however, in conjunction with the aforementioned concentrations of orthophosphate additive, the hexametaphosphate has been observed to effectively form a passivating film on the metal surfaces. After the formation of the passivating film, usually within a period of several hours to several days, the concentration of the hexametaphosphate additive can be reduced to a maintenance level, typically from about 0.1 to about 5ppm.

DESCRIPTION OF THE PREFERRED EMBODIMENT

This invention relates to the treatment of water and in particular to the treatment of potable waters such as municipal waters and the like to reduce the corrosivity of such waters on iron and mild steel surfaces.

Municipal waters, such as are contemplated for treatment by this invention, generally have a hardness from about 10 to about 1800 ppm, comprising dissolved magnesium and calcium bicarbonate and sulfate salts.

The invention comprises the simultaneous addition to the aforementioned water of a hexametaphosphate inhibitor and an orthophosphate buffer.

The hexametaphosphate inhibitor can be any water soluble hexametaphosphate, typically an alkali metal hexametaphosphate such as sodium, potassium, or lithium hexametaphosphate. Of these, sodium is the most preferred, because of its lesser cost.

The orthophosphate buffer employed as the coadditive is phosphoric acid and/or a soluble dihydrogen orthophosphate salt, typically an alkali metal dihydrogen orthophosphate, e.g., sodium, potassium or lithium dihydrogen othophosphate.

It is believed that the hexametaphosphate inhibitor functions in passivating the metal surface by depositing thereon as a protective film or layer. The formation of this protective or passivating film is believed to be hindered or retarded by the formation of a barrier of ferrous hydroxide which is normally formed as a product of the corrosion of an iron or mild steel surface. It is believed that the formation of this barrier the orthophosphate buffer since the orthophosphate accepts hydroxyl ions liberated during the progress of the corrosion and thereby prevents the formation of the ferrous hydroxide barrier.

The aforementioned mechanism is in general accordance with the electrochemical mechanism of corrosion in which the metal surface is believed to develop anodic and cathodic surface regions. The reaction which occurs at the anodic regions of the metal surface is as follows:

$$Fe \rightarrow Fe^{++} + 2e,$$

while the reaction which occurs at the cathode is as follows:

$$\tfrac{1}{2} O_2 + H_2O + 2e \rightarrow 2(OH)^-$$

The hydroxyls liberated at the cathodic regions combine with the ferrous ions in the proximity of the anodic regions of the metal surface to form insoluble ferrous hydroxide. Other reactions, which can occur to lesser degree, are the oxidation of the ferrous hydroxide to hydrous ferric hydroxide in the presence of water and dissolved oxygen as follows:

$$Fe(OH)_2 + \frac{1}{2} H_2O + \frac{1}{4} O_2 \rightarrow Fe(OH)_3$$

In addition to the foregoing reactions, the ferrous hydroxide can react with carbonates in the water to form hydrated ferrous carbonate as follows:

$$Fe^{++} + 2OH^- + 2H^+ + CO_3^- \rightarrow FeCO_3.H_2O + H_2O.$$

The addition of orthophosphoric acid to the water in the minor amounts employed in the invention does not significantly alter the pH of the water since any bicarbonate ions in the water react with the phosphoric acid to provide the dihydrogen and monohydrogen orthophosphate anion in accordance with the following reactions:

$$H_3PO_4 + HCO_3^{31} \rightarrow H_2PO_4^{31} + H_2CO_3$$

$$H_3PO_4 + 2HCO_3^- \rightarrow HPO_{4=} + 2H_2CO_3$$

The phosphoric acid is at near infinite dilution at the aforementioned concentrations such that the overall reaction is as follows:

$$H_2PO_4^- \rightarrow HPO_4= + H^+$$

The result of this is to provide an orthophosphate buffering anion which is capable of functioning as a hydroxyl scavenger in accordance with the following reaction:

$$OH^{31} + H_2PO_4^- \rightarrow HPO_4= + H_2O$$

FIG. 1 illustrates the orthophosphoric acid-base titration curve 10 and demonstrates the buffering capacity of the orthophosphate anion in the preferred operational range 12 shown by the cross-hatched area. At pH values from 6.7 to 7.3, 0.6 equivalents of base can be neutralized.

It is believed that the orthophosphate reaction with the hydroxyl ions liberated as the initial corrosion products at the cathodic regions functions to prevent the formation of ferrous hydroxide and thereby inhibits the formation of a ferrous hydroxide barrier on the metal surface that could interfer with the formation of the passivating hexametaphosphate film.

The concentration of the metaphosphate employed for the passivating treatment is from 10 to about 25, preferably from about 10 to 20 ppm in the water under treatment. The concentration of the phosphoric acid or soluble dihydrogen orthophosphate salt employed in the invention is from 5 to about 25, preferably from 10 to about 20, ppm.

The additives can be incorporated in the water in any suitable manner and, if desired, a powdered mixture of the dihydrogen orthophosphate salt and the alkali metal hexametaphosphate salt can be prepared as a dry granular mixture in weight proportions from 0–2 to about 2–1 and this mixture can be introduced as a single additive to the water under treatment.

After the metal surfaces exposed to contact with the treated water have received a passivating film, generally within a period of from several hours to several days following the addition of the corrosion inhibiting additives, the concentrations of the metal phosphate additive can be reduced in the treated water. It has been found that the concentration of the hexametaphosphate inhibitor can be reduced to a level from about 0.1 to about 5, preferably from about 0.6 to about 2 ppm and the additives will, nevertheless, be effective in preventing corrosion.

The corrosivity of the treated water on iron and mild steel surfaces can be continually monitored, if desired, by suspending test coupons of iron and mild steel in the treated water. Such coupons can be suspended in the water treatment plant supplying the water to municipal or industrial users and can also be located at the point of delivery of the water to these municipalities or industries. The normal appearance of the passivating film on the anodic portion of a test coupon is a translucent blue coloration, characteristic of iron coordination compounds. The adjacent cathodic regions of the metal will normally exhibit a yellow to white translucent coloration. In addition to, or besides, visual observation, the coupons can be periodically weighed to determine any weight loss, indicative of overall corrosion rates or can be optically examined for any pitting or other evidence of stress corrosion.

The following examples will serve to demonstrate the practice of the invention and serve to illustrate results obtainable thereby.

EXAMPLE 1

In this and the following examples the corrosion rates characteristic of untreated and treated waters were determined by immersing coupons of mild steel having the dimensions of 1 by 2 by 1/16th inch in the water. Unless otherwise indicated the duration of each test was one day. The test couponds were precorroded, cleaned and acid washed with a solution of 15 weight percent hydrochloric acid and 3 weight percent citric acid.

In the first experiment a two liter sample of a municipal water was treated by the addition of sodium hexametaphosphate to provide a concentration of the latter of 10 ppm and the pH of the water was adjusted to 6.65 by the addition of orthophosphoric acid. A second sample of the water was untreated. The aforementioned test coupons were weighted and a coupon was placed in each of the treated and untreated water samples and maintained therein for the 24 hour test period while magnetically stirring the water.

The pH values of the water samples were periodically observed. It was observed that the pH values increased, however, the rate of increase slowed during the test in a progressive manner. This is graphically shown in FIG. 2 where the solution pH values are plotted for the test duration.

It was observed that after two hours the untreated water became cloudy, characteristic of an iron oxide precipitate, and the water became increasing turbid during the remaining portion of the test. The water treated in accordance with the invention remained clear throughout the test. At the conclusion of the one-day test the test coupons were removed, dried and weighed to determine that the coupon in the untreated water corroded at a rate of 118.67 milligrams per square decimeter per day while the coupon in the treated water exhibited no appreciable corrosion rate, the date indicated a weight loss of 3.01 milligrams per square decimeter per day of this specimen, a value within the range of experimental error.

Another test coupon which was not acid cleaned prior to immersion in the treated water was also exposed to the treated water and observed to gain 6.73 milligrams per square decimeter per day. This weight gain was also within the experimental error of the test and the test, therefore, revealed that the test coupons in the treated water did not undergo any detectible weight change.

EXAMPLE 2

A series of experiments were performed in which the concentration of orthophosphate and hexametaphosphate corrosion inhibitors were varied. In these experiments, a stream of the water under investigation was passed through a test cell at a flow rate of two liters per minute. Mild steel test coupons were suspended in the water stream upstream and downstream of the point of inhibitor addition. The weight losses experienced by the coupons were determined at the conclusion of each experiment. The following table summarizes the results obtained:

TABLE I

| Inhibitor Dosages | | | Specimen Weight | |
|---|---|---|---|---|
| $H_3PO_4$ (ppm) | $Na_6P_6O_{18}$ (ppm) | Eff. pH | Loss (−) or Gain (+) Grams | Mdd |
| 0 | 0 | 7.73 | −0.0198* | −70.13 |
| 0 | 10 | 7.65 | −0.0095 | −33.65 |
| 5 | 10 | 7.23 | −0.0022 | − 7.79 |
| 10 | 10 | 7.06 | −0.0012 | − 4.25 |
| 20 | 10 | 6.82 | −0.0010 | + 3.45 |

The preceding data demonstrate that the hexametaphosphate additive, used alone, is ineffective in achieving the desired corrosion resistance while the simultaneous addition of the orthophosphate additive achieves acceptable corrosion resistance.

EXAMPLE 3

The test apparatus described in Example No. 2 was employed in this example using a three day test period. In these experiments, hydrochloric acid was substituted for the orthophosphoric acid and the orthophosphoric acid was employed as the sole additive. The data obtained are summarized in the following table:

TABLE 2

| Dosages | | | Eff. | Specimen | |
|---|---|---|---|---|---|
| HCL (mg/l) | $H_3PO_4$ (mg/l) | $Na_6P_6O_{18}$ (mg/l) | Water pH | Metal Loss (gms) | Mdd |
| 0 | 0 | 0 | 7.55 | 0.1556* | 183.72 |
| 17.5 | 0 | 10 | 7.00 | 0.1301 | 153.62 |
| 0 | 20 | 0 | 6.95 | −.1164 | 137.44 |

The preceding data evidence that a strong mineral acid, such as hydrochloric acid cannot be substituted for the orthophosphoric acid in successful corrosion inhibition since the joint use of hydrochloric acid and sodium hexametaphosphate had no significant reduction in corrosion rate. The data also evidence that orthophosphoric acid, when used alone, is likewise ineffective in inhibiting corrosion.

EXAMPLE NO. 4

In this example, a single test coupon was treated with progressively reduced dosages of sodium hexametaphosphate using a constant dosage of orthophosphoric acid in the continuous flow test equipment described in Example 2. The test coupon was exposed under each test condition to a test period of 24 hours, then removed, dried and weighed without acid washing. After recording the weight loss or gain, the test coupon was reimmersed in the water for the successive 24 hour test. The treated water was tested at ambient temperatures (74° F) and at an elevated temperature (140° F) in separate experiments. The data obtained are set forth in the following table:

TABLE 3

| Inhibitor | Dosages | Eff. | Specimen Corrosion Rate | |
|---|---|---|---|---|
| $Na_6P_6O_{18}$ (mg/l) | $H_3PO_4$ (mg/l) | Water pH | Cold Water Mdd | Hot Water Mdd |
| 10 | 20 | 6.84 | −4.60 | −4.60 |
| 8 | 20 | 6,92 | +3.90 | −9.20 |
| 6 | 20 | 7.00 | −0.71 | −4.25 |
| 4 | 20 | 6.91 | −2.13 | +2.83 |
| 3 | 20 | 7.22 | −1.77 | — |
| 2 | 20 | 6.94 | 0.00 | −1.77 |
| 1 | 20 | 6.73 | −2.83 | −8.50 |
| 0.5 | 20 | 7.01 | +3.19 | — |
| 0 | 20 | 6.99 | +8.50 | −12.75 |

The data demonstrate that the hexametaphosphate inhibitor can be reduced to remarkably low concentrations once the passivating film has formed on the test specimen. The formation of the passivating film was observed following the first experiment of the series when its was observed that a translucent blue film or coating formed at the anodic, etched portions of the test coupon.

The last experiment in the series, in which the addition of the sodium hexametaphosphate was entirely ceased, demonstrated the necessity for continuous addition of this material since the test coupon following the experiment was observed to have yellow to white precipitates in the blue film, characteristic of a ferrous orthophosphate precipitate. The continued exposure would result in destruction of the passivating metaphosphate film.

EXAMPLE NO. 5

A stream of municipal water flowing at a rate of 2 liters per minute was treated by the addition thereto of sodium hexametaphosphate at a concentration of 10 ppm and orthophosphoric acid at a concentration of 20 ppm. Two test coupons with a previous history of exposure were placed in the flowing stream of treated water for a period of one week. The test coupons had been previously corroded by exposure to the municipal untreated water, one specimen having been corroded in the untreated water at ambient temperature whiel the other specimen was corroded in hot (140° F) water.

After exposure in the treated water for one week, the test coupons were removed and inspected. The test coupon having previously been corroded in ambient temperature water was observed to be free of all deposits and had a translucent blue coloration, characteristic of the metaphosphate passivating film. The specimen corroded in the hot, untreated water was essentially unchanged in appearance. No appreciable corrosion was detected on either sample.

While the invention has been described and illustrated with reference to the presently preferred additives, it is not intended that the invention be unduly limited by this description of preferred embodiments. Instead, it is intended that the invention be defined by the method steps, and reagents and their obvious equivalents, set forth in the following claims.

I claim:

1. A method for inhibition of the corrosion of iron and steel surfaces in contact with water which consists of:

(a) adding to the water a limited amount of an alkali metal hexametaphosphate to provide a concentration therein up to about 30 parts per million, insufficient, used alone, to prevent said corrosion; and (b) adding to the water a sufficient amount of a phosphate buffer, selected from the group consisting of orthophosphoric acid and alkali metal dihydrogen orthophosphate, to maintain the pH of said water at a value from about 6.5 to about 7.5, whereby said corrosion is inhibited.

2. The method of claim 1 wherein said phosphate buffer and hexametaphosphate are added in weight proportions from about 2/1 to about 1/2.

3. The method of claim 1 wherein said phosphate buffer is added at a concentration from 5 to about 20 ppm.

4. The method of claim 1 wherein said phosphate buffer is added at a concentration sufficient to maintain the pH of said water from 6.8 to 7.1.

5. The method of claim 1 wherein said phosphate buffer is added at a concentration sufficient to react with hydroxyl ions liberated at cathodic regions of said iron and steel surfaces to maintain the pH of said water substantially neutral.

6. The method of claim 1 wherein said hexametaphosphate is added initially at a concentration from 10 to about 30 ppm until said surfaces are coated with a passivating film and, thereafter, is added at a reduced concentration, from about 0.1 to about 5 ppm.

7. A method for inhibition of the corrosion of iron and steel surfaces of municipal water system in contact with water which consists of:

(a) adding to the water of the municipal water system a limited amount of an alkali metal hexametaphosphate to provide a concentration therein up to about 30 parts per million, insufficient, used alone, to prevent said corrosion; and (b) adding to said water a sufficient amount of a phosphate buffer, selected from the group consisting of orthophosphoric acid and alkali metal dihydrogen orthophosphate, to maintain the pH of said water at a value from about 6.5 to about 7.5, whereby said corrosion is inhibited.

8. The method of claim 1 wherein said phosphate buffer and hexametaphosphate are added in weight proportions from about 2/1 to about 1/2.

9. The method of claim 1 wherein said phosphate buffer is added at a concentration from 5 to about 20 ppm.

10. The method of claim 1 wherein said phosphate buffer is added at a concentration sufficient to maintain the pH of said water from 6.8 to 7.1.

11. The method of claim 1 wherein said phosphate buffer is added at a concentration sufficient to react with hydroxyl ions liberated at cathodic regions of said iron and steel surfaces to maintain the pH of said water substantially neutral.

12. The method of claim 1 wherein sid hexametaphosphate is added initially at a concentration from 10 to about 30 ppm until said surfaces are coated with a passivating film and, thereafter, is added at a reduced concentration, from about 0.1 to about 5 ppm.

* * * * *

UNITED STATES PATENT OFFICE

CERTIFICATE OF CORRECTION

Patent No. 4,105,406 Dated August 8, 1978

Inventor(s) W. BRUCE MURRAY

It is certified that error appears in the above-identified patent and that said Letters Patent are hereby corrected as shown below:

Column 3, line 20, change "31" to --$^{-}$--, both instances.

Column 3, line 33, change "31" to --$^{-}$--.

Column 4, line 3, change "0.6" to --0.5--.

Column 6, line 10, change "6,92" to --6.92--.

Claim 12, line 1, change "sid" to --said--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*